US007794269B2

(12) United States Patent
Chin et al.

(10) Patent No.: US 7,794,269 B2
(45) Date of Patent: Sep. 14, 2010

(54) DETECTING DEVICE AND CONNECTOR MODULE THEREOF

(75) Inventors: Chung-Ta Chin, Taipei (TW); Yuan-Te Chang, Taipei (TW); Ching-Chung Chen, Taipei (TW); Ren-Shiang Tsai, Taipei (TW); Chia Ching Lin, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 0 days.

(21) Appl. No.: 12/349,450

(22) Filed: Jan. 6, 2009

(65) Prior Publication Data

US 2009/0186519 A1 Jul. 23, 2009

(30) Foreign Application Priority Data

Jan. 22, 2008 (TW) ..... 97102340 A

(51) Int. Cl.
*H01R 3/00* (2006.01)

(52) U.S. Cl. ..... 439/489

(58) Field of Classification Search ..... 439/439, 439/660, 188, 357, 352, 350, 358
See application file for complete search history.

(56) References Cited

U.S. PATENT DOCUMENTS 5,836,785 A * 11/1998 Lee ..... 439/505
6,688,907 B2 * 2/2004 Yamaoka et al. ..... 439/489
6,725,177 B2 * 4/2004 David et al. ..... 702/183
6,840,817 B2 * 1/2005 Chen ..... 439/676
7,581,978 B1 * 9/2009 Briant ..... 439/358
7,588,470 B2 * 9/2009 Li et al. ..... 439/660
2003/0049962 A1 * 3/2003 Raudenbush et al. ..... 439/489

FOREIGN PATENT DOCUMENTS

CN 1375120 A 10/2002

* cited by examiner

*Primary Examiner*—Jean F Duverne
(74) *Attorney, Agent, or Firm*—Quintero Law Office

(57) ABSTRACT

A detecting device is used to detect the connection of an electronic device. The detecting device includes a circuit board and a connector module. The circuit board includes a power terminal and a signal processing unit. The connector module includes a body and a detecting member. The body has a connecting port and a connecting sidewall. The detecting member is disposed on the connecting sidewall and electrically connected to the power terminal and the signal processing unit, and it has a potential. When a plug of the electronic device is connected to the connecting port, the plug contacts the detecting member to change the potential. The change of the potential is detected by the signal processing unit such that the connection between the electronic device and the connector module is confirmed.

10 Claims, 4 Drawing Sheets

DETECTING DEVICE AND CONNECTOR MODULE THEREOF

BACKGROUND OF THE INVENTION

1. Field of the Invention

The invention relates to a connector module and, more particularly, to a connector module having a function of detecting the connection of an electronic device.

2. Description of the Related Art

Connectors of most electronic devices do not have a detecting function. When an external device is plugged into an electronic device, the communication protocol between the electronic device and the external device or programs capable of exchanging a predetermined control signal or character between the electronic device and the external device are usually used to notify whether the external device is plugged into the electronic device. However, not all devices have the function of actively exchanging the predetermined signal or character initially. Further, when the system is closed or enters into the power saving mode, the method that confirms whether the external device is connected to the electronic device via telecommunication transmission is inapplicable.

A conventional plug detecting device is disclosed, and it detects whether an external device is connected via a metal piece disposed at a circuit board and electrically connected to a signal processing unit. Since the metal piece should be very close to the connector of the plug detecting device to allow the plug of the plugged external device to contact the metal piece further to change the potential of the metal piece, the circuit board provided with the metal piece also should be disposed closely to the opening of the connector. In this way, the position of disposing the circuit board goes against the design of stacking a plurality of connectors. The design of directly disposing the metal piece at the circuit board is possible to make the connector and the metal piece have bad contact.

BRIEF SUMMARY OF THE INVENTION

The invention provides a connector module for connecting an electronic device having a plug. The connector module includes a body and a detecting member. The body has a connecting port and a connecting sidewall. The detecting member is disposed on the connecting sidewall and electrically connected to a power terminal and a signal processing unit, and it has a potential. When the plug is connected to the connecting port, the plug contacts the detecting member to change the potential, and the signal processing unit can detect the change of the potential to confirm that the electronic device is connected to the connector module.

The invention provides a detecting device for detecting the connection of an electronic device, and the detecting device includes a body, a circuit board and a detecting member. The body has a connecting port and a connecting sidewall. The circuit board is disposed in the body and has a power terminal and a signal processing unit. The detecting member is disposed on the connecting sidewall and electrically connected to the power terminal and the signal processing unit, and it has a potential. When a plug of the electronic device is connected to the connecting port, the plug contacts the detecting member to change the potential, and the signal processing unit can detect the change of the potential.

These and other features, aspects, and advantages of the present invention will become better understood with regard to the following description, appended claims, and accompanying drawings.

DETAILED DESCRIPTION OF THE EMBODIMENTS

Figure 1:
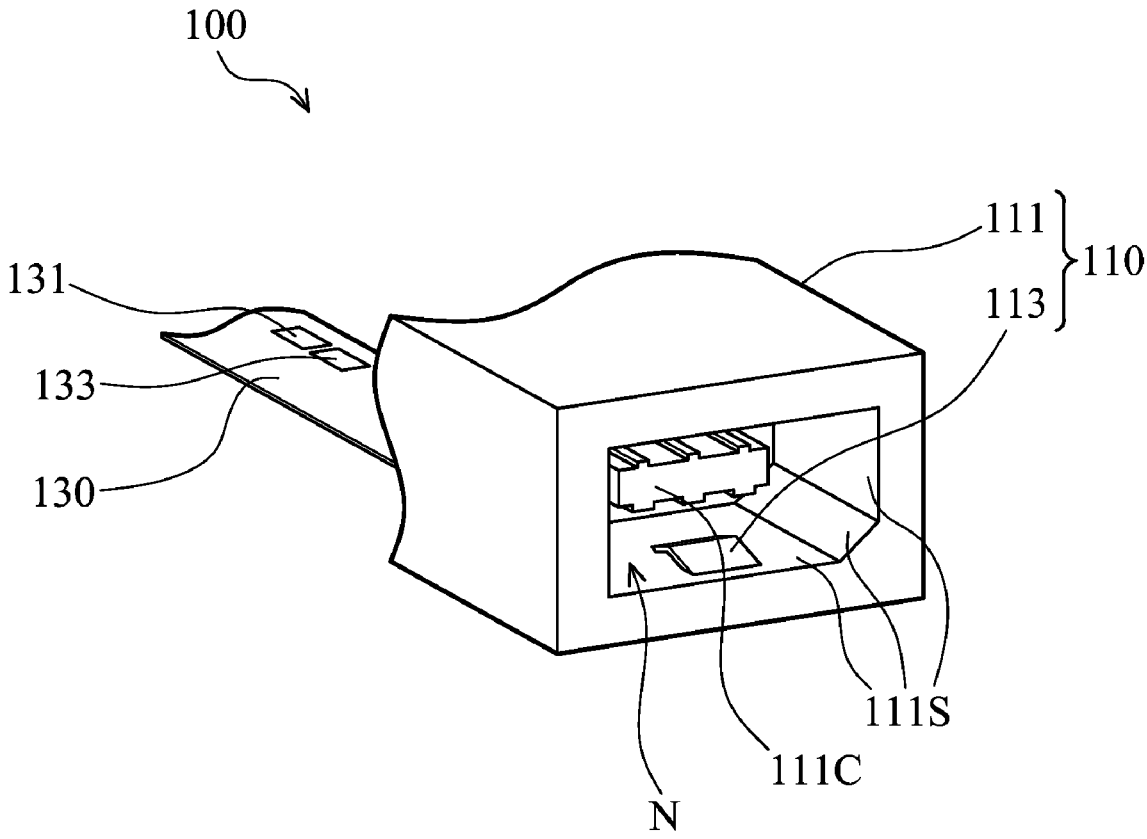
FIG. 1 is a schematic diagram showing a detecting device of one embodiment of the invention.

As shown in FIG. 1, a detecting device 100 of an embodiment of the invention is used to detect the connection of an electronic device.

The electronic device has a plug having a metal covering and capable of being connected to the detecting device 100.

Figure 4:
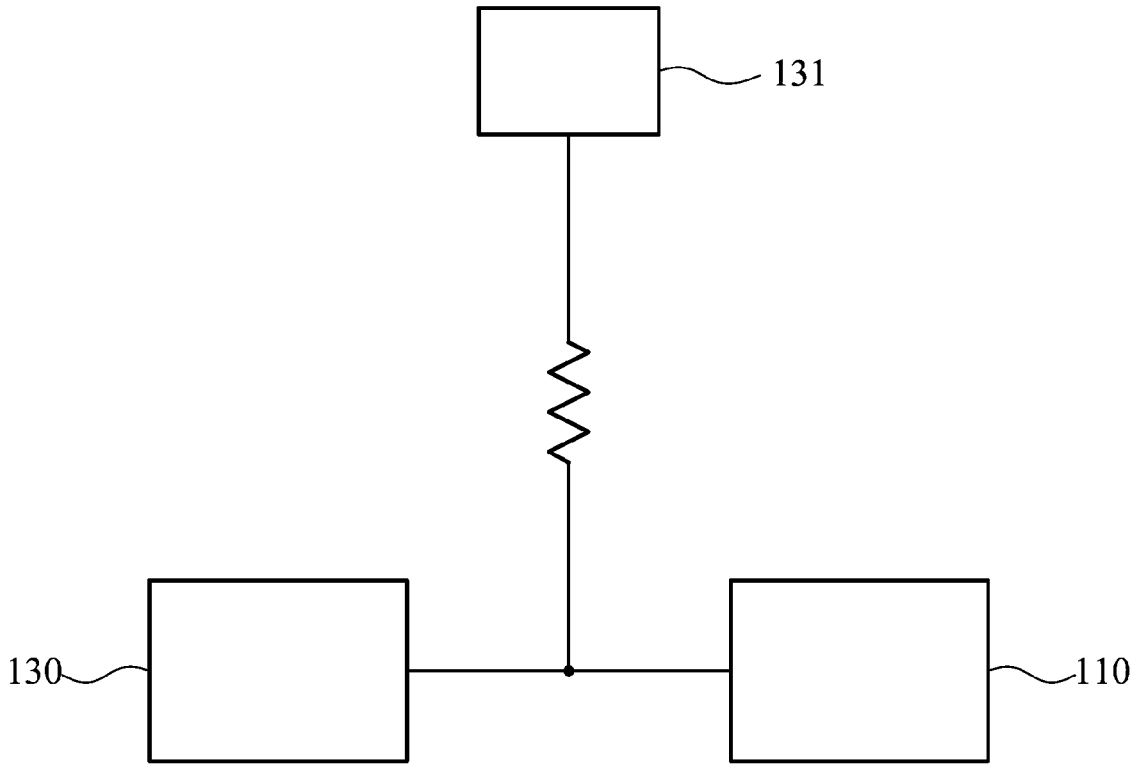
FIG. 4 is a schematic diagram showing the connection relationship between a connector module and a circuit board of one embodiment of the invention.

The detecting device 100 includes a connector module 110 and a circuit board 130, and the connector module 110 includes a body 111 and a detecting member 113. The circuit board 130 is disposed in the body 111 and has a power terminal 131 and a signal processing unit 133. FIG. 4 is a schematic diagram showing the connection relationship between the connector module and the circuit board of the embodiment of the invention. As shown in FIG. 4, the circuit board 130 is electrically connected to the connector module 110, and it provides electricity for the connector module 110 via the power terminal 131.

The body 111 has an opening N, a connecting port 111C and a plurality of connecting sidewalls 111S. The connecting port 111C is disposed in the opening N, and the connecting sidewalls 111S are formed inside the opening N and around the connecting port 111C.

Figure 2:
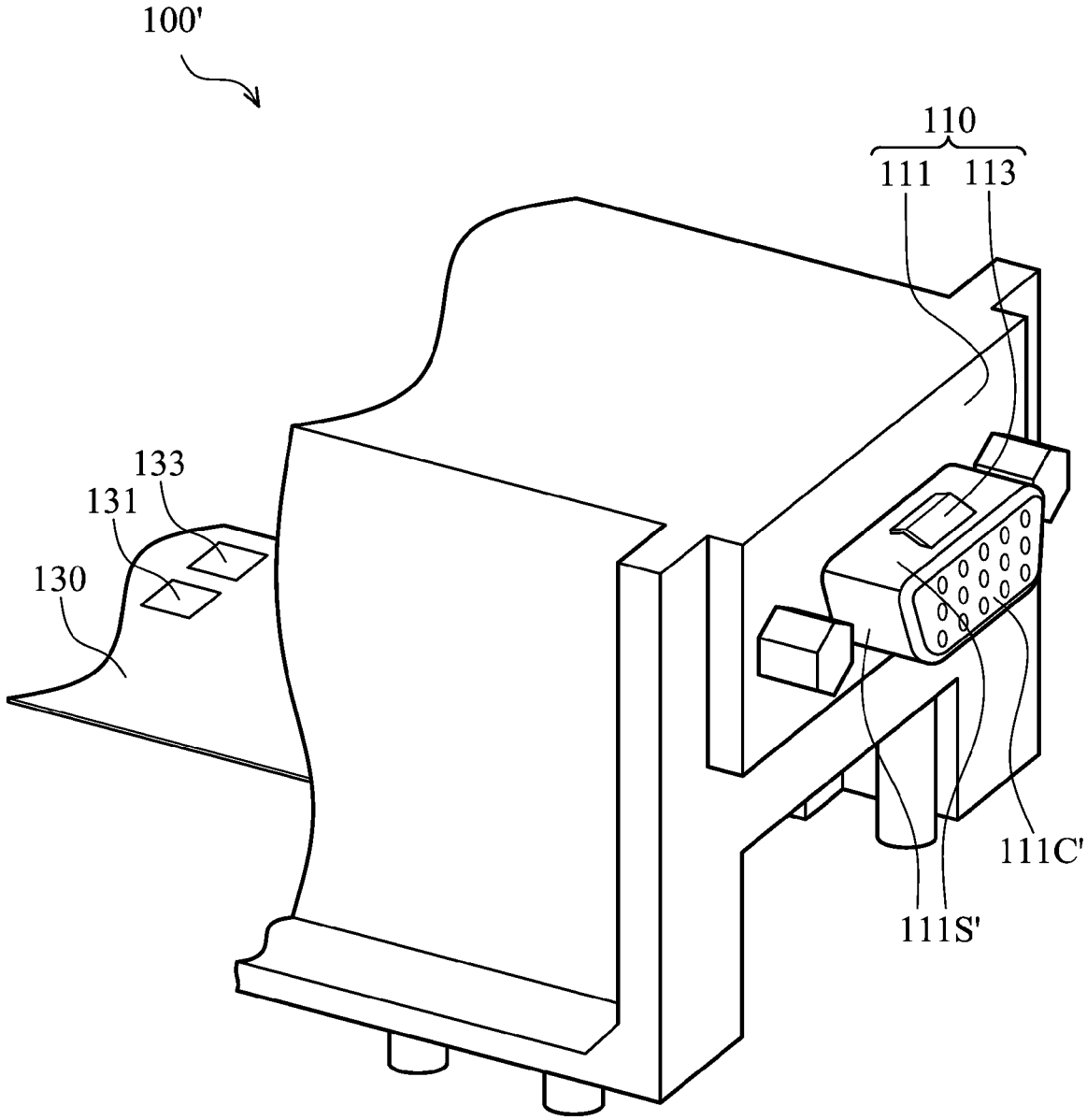
FIG. 2 is a schematic diagram showing a detecting device of another embodiment of the invention.

As shown in FIG. 2, in another embodiment of the invention, the connector module 110 of a detecting device 100' includes a body 111 and a detecting member 113. The body 111 has a connecting port 111C' and four connecting sidewalls 111S'. The connecting port 111C' protrudes from the body 111, and the connecting sidewalls 111S' are formed at the outer surface of the connecting port 111C' and around the connecting port 111C'.

As shown in FIG. 1 and FIG. 2, the detecting member 113 may be a metal piece or a metal pin and is disposed on one of the connecting sidewalls 111S and 111S'. The detecting member 113 is insulated from the connecting sidewalls 111S and 111S'. The detecting member 113 is electrically connected to the power terminal 131 and the signal processing unit 133 and has a potential. The detecting member 113 is not limited to the above metal piece or the metal pin, and it can be a metal member with any form. The detecting member 113 is protrudently disposed on the connecting sidewalls 111S and 111S'.

When the plug of the electronic device is connected to the connecting port 111C, the metal portion of the plug contacts the detecting member 113 to change the potential of the detecting member 113. When the signal processing unit 133 detects the change of the potential, it can confirm that the electronic device is connected to the connector module 110.

Figure 3:
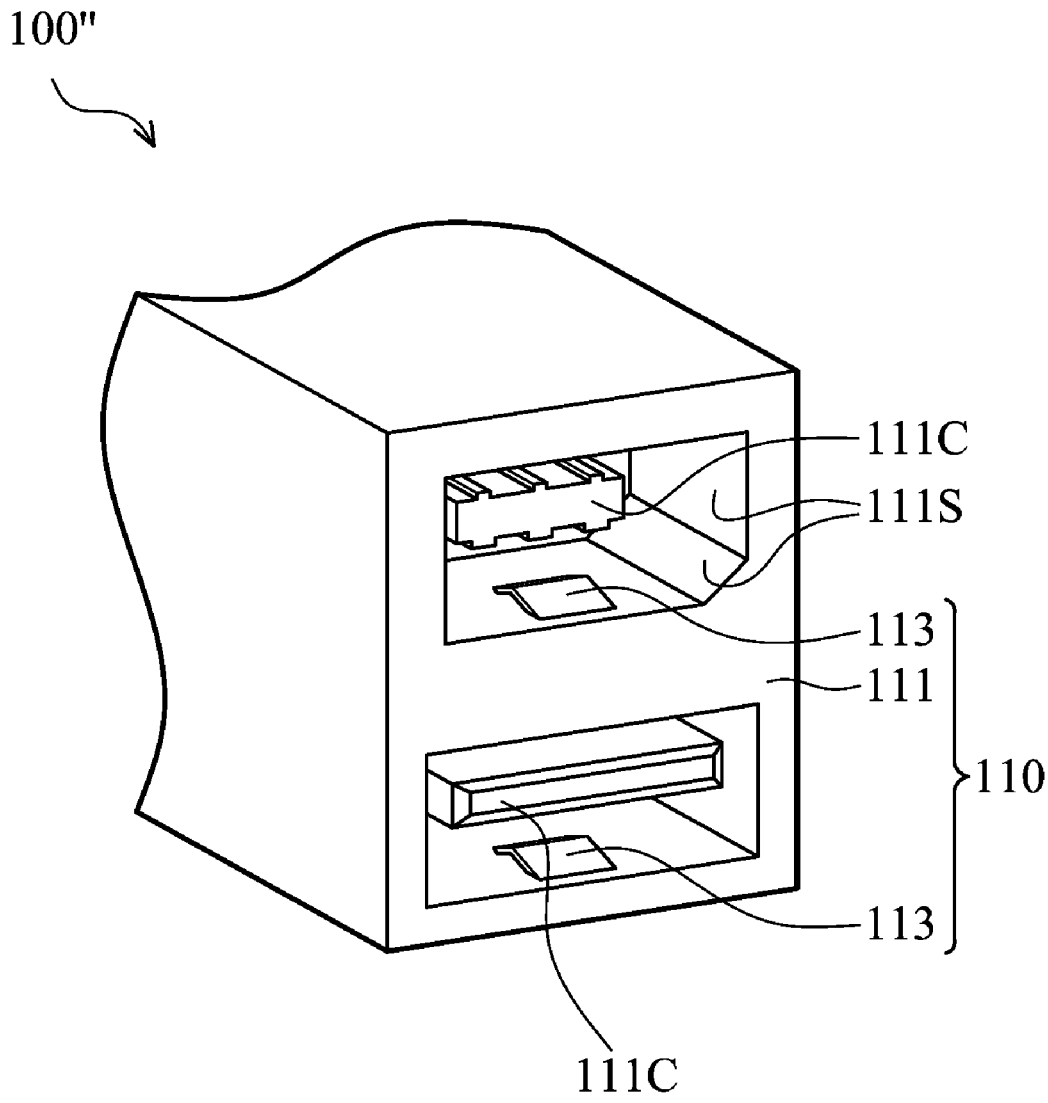
FIG. 3 is a schematic diagram showing a detecting device of another embodiment of the invention.

The detecting devices 100 and 100' of the embodiments of the invention can be used to detect the connection of any type of plug, such as 1394, VGA, ESATA, USB, DVI, HDMI and COM. Only if the plug has a metal covering, the potential of the detecting member 113 is changed when the plug contacts the detecting member 113. In the embodiments of the invention, the detecting member 113 is directly disposed on the connecting sidewalls 111S and 111S', and therefore, connector modules 110 of a detecting member 100" can be stacked (as shown in FIG. 3) to save space. Furthermore, no matter the electronic device has a male connector or a female connector, it can be detected via the detecting device 100 or the detecting device 100' of the embodiment of the invention (as shown in FIG. 1 and FIG. 2).

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A connector module for connecting an electronic device having a plug, the connector module comprising:

a body having a connecting port and a connecting sidewall; and a detecting member disposed on the connecting sidewall, electrically connected to a power terminal and a signal processing unit and having a potential;

wherein when the plug is connected to the connecting port, the plug contacts the detecting member to change the potential, and the signal processing unit detects the change of the potential to confirm that the electronic device is connected to the connector module.

2. The connector module according to claim 1, wherein the detecting member is insulated from the connecting sidewall.

3. The connector module according to claim 1, wherein the detecting member is a metal piece or a metal pin.

4. The connector module according to claim 1, wherein the body has an opening, the connecting sidewall is formed inside the opening, and the connecting port is disposed in the opening.

5. The connector module according to claim 1, wherein the connecting port protrudes from the body, and the connecting sidewall is formed at the outer surface of the connecting port.

6. A detecting device for detecting the connection of an electronic device, the detecting device comprising:

a body having a connecting port and a connecting sidewall;

a circuit board disposed in the body and having a power terminal and a signal processing unit; and a detecting member disposed on the connecting sidewall, electrically connected to the power terminal and the signal processing unit and having a potential;

wherein when a plug of the electronic device is connected to the connecting port, the plug contacts the detecting member to change the potential, and the signal processing unit is capable of detecting the change of the potential.

7. The detecting device according to claim 6, wherein the detecting member is insulated from the connecting sidewall.

8. The detecting device according to claim 6, wherein the detecting member is a metal piece or a metal pin.

9. The detecting device according to claim 6, wherein the body has an opening, the connecting sidewall is formed inside the opening, and the connecting port is disposed in the opening.

10. The detecting device according to claim 6, wherein the connecting port protrudes from the body, and the connecting sidewall is formed at the outer surface of the connecting port.

* * * * *